United States Patent [19]

Interlante

[11] 4,251,972

[45] Feb. 24, 1981

[54] INTERIOR CEILING PANEL SUPPORT

[76] Inventor: John B. Interlante, 905 E. Evesham Rd., Runnemede, N.J. 08078

[21] Appl. No.: 25,332

[22] Filed: Mar. 30, 1979

[51] Int. Cl.[3] ..... E04B 1/38

[52] U.S. Cl. ..... 52/714; 52/404

[58] Field of Search ..... 52/404, 407, 714, 712, 52/410, 406, 773

[56] References Cited

U.S. PATENT DOCUMENTS

| | | | |
|---|---|---|---|
| 4,069,636 | 1/1978 | Kessler | 52/407 X |
| 4,075,807 | 2/1978 | Alderman | 52/407 |
| 4,117,641 | 10/1978 | Wells | 52/404 |

*Primary Examiner*—Carl D. Friedman

*Attorney, Agent, or Firm*—Thomas A. Lennox

[57] ABSTRACT

An interior ceiling panel support member which is used in building structures having purlins with raised toes, the support to extend between purlins resting on top of one toe and snapping onto the other toe from below.

10 Claims, 3 Drawing Figures

INTERIOR CEILING PANEL SUPPORT

BACKGROUND OF THE INVENTION

This invention relates to pre-engineered buildings and in particular those pre-engineered buildings which are constructed of purlins having a lower horizontal member with a raised toe. This type of purlin includes popular Z-shaped purlin joist with the raised toe of the lower section of the Z-shape, and the C-shaped purlin again with the raised toe on the lower horizontal member. There are other joist cross-sectional shapes, but this invention is particularly suited for shapes having this configuration.

In the typical construction of these pre-engineered buildings, the purlins are used to construct the roof framing. A roof sheet, typically a sandwich panel of aluminum sheet around foam, fiber glass reinforced sheet or corrugated painted aluminum sheet is attached to the outside of the upper horizontal of the C or Z-shaped purlin joist. For some uses of buildings, it is satisfactory to leave the interior unfinished. However, in order to provide a finished interior ot to insulate the building sufficiently, it is necessary to support ceiling sheets such as accoustical panels, translucent lighting panels or insulation sheets such as glass fiber batting or like sheets between adjacent purlins. It has been suggested to provide sheets of metal between the purlins on which the ceiling sheet may rest. It was proposed to rest one end of the support on the top of the lower horizontal member of one purlin and provide a hook on the other end of the support to hook over the entire upraised toe of the next adjacent purlin.

This was found entirely unsatisfactory since a rigid body was required which was not easily installed without deforming the support. An original proposal was considered to hook over the upraised toe of the purlin which angled upwardly at an angle of about 45 degrees. However, following the shape upraised toe of the purline on the outside and returning the hook around the inside of the toe to prevent the support from falling off was difficult to install and required deformation of the support in order to get it into place.

Facing these problems, it is an object of this invention to provide a support to hold ceiling sheets across the roof of pre-engineered buildings constructed with purlins having a lower horizontal member with an upraised toe.

It is an additional object of this invention to provide a support which may be easily installed without deforming the support.

It is a further object of this invention to provide a support which by its shape will spring into place and hold on the upraised toe of the purlin without extending to the inside surface of that upraised toe.

It is an additional object of this invention to provide a support which combines reinforcement of the support with a shape to also provide the springing action in the support to hold it in place resting on top of one adjacent purlin and clipping underneath onto the toe of an adjacent purlin.

SUMMARY OF THE INVENTION

I have been able to satisfy the above objects and provide a support that essentially snaps into place by utilizing reinforcing bends to provide not only the reinforcement but also the offset in height to cause the snap in effect and avoid the necessity of having the return of the hook surround the upright toe of the purlin. I have developed a support to hold ceiling sheets such as semi-rigid insulation boards across the roof between adjacent purlins constructed of a metal member of a length about equal to the center to center distance between adjacent purlins, plus an additional length to allow bearing on the upright toe. This length is sufficient to allow one end of the support to snap onto the upraised toe of one purlin from below extending under that lower horizontal member of the purlin and across the void between purlins to the nearest adjacent purlin and rest on top of the upraised toe of that adjacent purlin. This distance is not critical as long as there is sufficient length for the end to rest on that adjacent purlin. The metal member is formed in an inverted U-shape cross-section extending essentially the entire length for reinforcement and particularly extending all the way to the end of the support which rests on top of the upraised toe of the purlin. It is particularly advantageous to have the U-shape formed with the inside angles being slightly concave, preferably about 100 degrees. By extending the U-shape the length of the body, it provides a significant off-set between the top of the support resting underneath one purlin and the bottom of the other end of the support which rests on top of the adjacent purlin. When the end pressing underneath the purlin is hooked onto the upright toe, a springing action essentially snaps the support into place. The hook over the upraised toe is formed across the width of the support, preferably by just flattening the U-shape. Preferably, the flattened support is angled downwardly from the plane of the top of the support before it is angled upwardly to form an upright element extending outwardly and upwardly at an angle equal to or greater than the angle of the upraised toe preferably about 35 degrees to 60 degrees from the horizontal line of the length of the top of the body. The final element of the hook is a horizontal element extending from the top of the upright element and returning back almost parallel to the horizontal length of the body angled slightly downwardly so that it hooks only over the end of the upraised toe of the purlin. The vertical opening between the top of the inverted U-shaped member and the exposed end of horizontal element is greater than the vertical distance between the top of the upraised toe and the bottom of the lower horizontal of the purlin. It is preferred that the vertical distance between the inside corner between the upright element and the horizontal element and the line of a horizontal extension of the top of the inverted U-shaped member is less than the outside vertical dimension between the top of the upraised toe and the bottom of the lower horizontal of the purlin.

DESCRIPTION OF PREFERRED EMBODIMENTS

Figure 1:
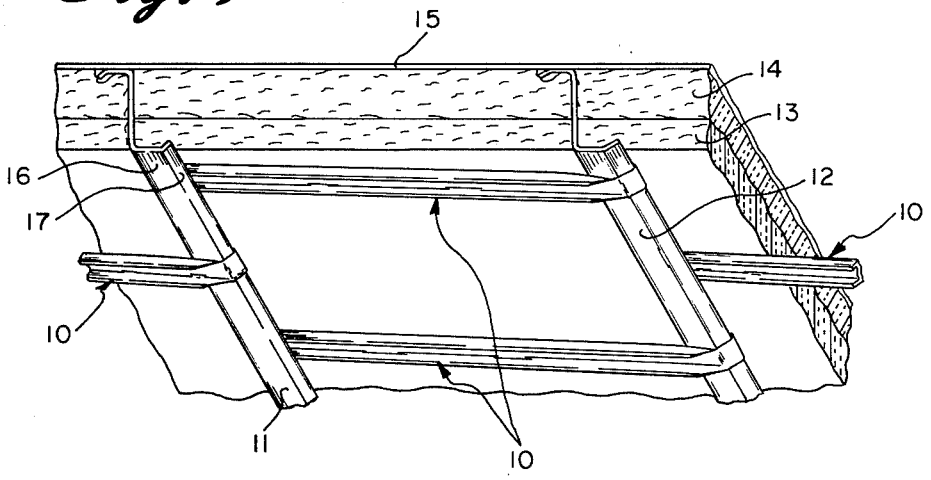
FIG. 1 is a perspective view showing the supports of this invention installed on adjacent purlins in the roof of a section of a building.

In FIG. 1 supports 10 are shown resting on and engaged on Z-shaped purlins 11 and 12 holding two inch insulation batting 13 and six inch insulation batting 14 against roof sheeting 15 which is attached to purlins 11 and 12. Each purlin 11 and 12 has a horizontal lower member 16 and upraised toe 17. These purlins are typical Z-shaped purlins used in the construction of pre-engineered buildings. Standard C-shaped purlins provide the same function and most have the same lower horizontal and upraised toe shape. Back to back double C-shaped purlins also have the same shape that the supports may be hooked upon.

Figure 2:
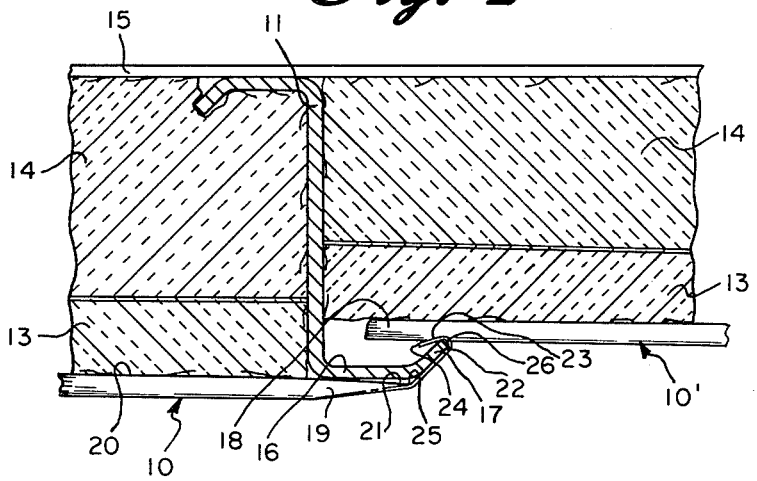
FIG. 2 is a cross-sectional view showing the purlin with one end of one support hooking over the upraised toe of the purlin and a second support of this invention resting on top of the upraised toe.

In FIG. 2 is an expanded cross-sectional view of purlin 11 to which roof sheet 15 is attached. Supports 10 and 10' hang by having free end 18 of support 10' rest on the lip of toe 17 of purlin 11. The distance free end 18 extends past the lip of toe 17 is not critical so long as there is sufficient distance to bear on toe 17 without falling off. Support 10 has been snapped into place over toe 17. The hook configuration includes end 19 which is angled downwardly away from the extension of the horizontal line of top 20 forming void 21 shown here as almost disappearing since support 10 is sprung into place. Downwardly angled end 19 is at a location where support 10 is almost entirely flat and is angled downwardly at about a 15 degree angle from the plane of top 20. This angle is more preferably in the range of 5 degrees to 30 degrees from the plane of top 20. At the end of downwardly angled end 19 the sheet is angled upwardly at an angle of about 45 degrees from the plane of top 20 to form upright element 22 which is, in turn, formed backward on itself to form horizontal element 23 terminating in end 24. Element 23 is almost parallel to top 20 but is angled downwardly at an angle of about 2 degrees from the horizontal line. The distance between end 24 and inside corner 25 is more than the outside vertical dimension of purlin toe 17 that being the distance between the end of toe 17 and the bottom of horizontal element 16 of the purlin. This allows the hook end of support 10 to be slipped onto toe 17 without springing the support. In this embodiment the vertical distance between inside corner 26 and a horizontal line extension of top 20 is less than the same outside dimensions of toe 17. Thus, when support 10 is snapped into place an additional springing action takes place further closing void 21.

Figure 3:
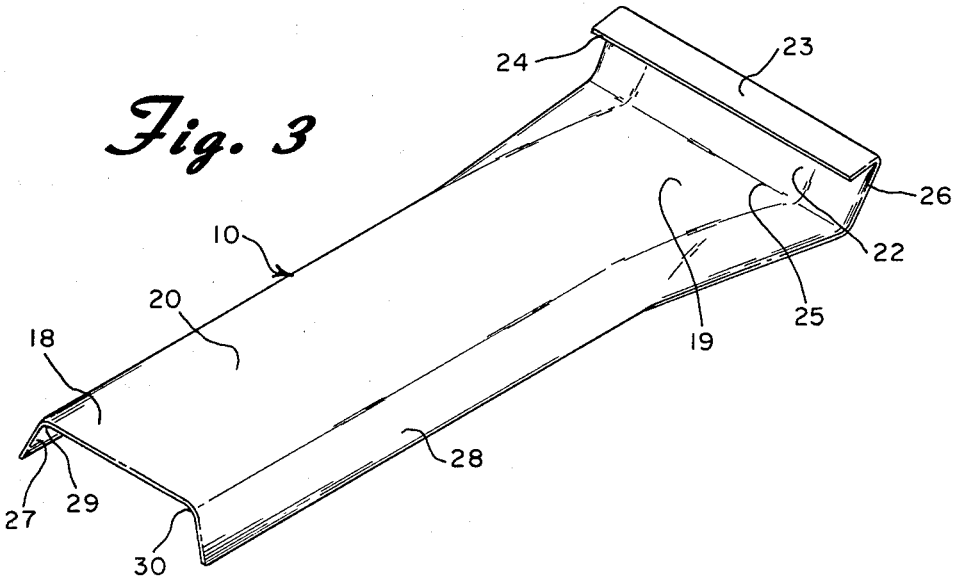
FIG. 3 is a perspective view of the support of this invention.

In FIG. 3 support 10 as pictured in a foreshortened perspective drawing, is formed from a 0.019 inch thick aluminum sheet 62 inches long and four and one/half inches wide. Most of the entire length of support 10 is formed in an inverted U-shape with downward extending flanges 27 and 28, each being about three-quarters of an inch long leaving top 20 to be about three inches wide. Inside angles 29 and 30 are each about 100 degrees providing not only reinforcement along the length of support 10 but an additional springing action to lock support 10 in place. It is preferred that inside angles 29 and 30 be greater than 90 degrees and less than 110 degrees. At end 19 the sheet is almost completely flattened as flanges 27 and 28 approach the plane of top 20. End 19 is angled downwardly about 15 degrees from the horizontal extension of the plane of top 20. End 19 terminates at inside corner 25 as the sheet is bent upwardly to form upright element 22 which, in turn, terminates at inside corner 26 as the sheet is further formed to return and form horizontal element 23 which is angled downwardly slightly toward the horizontal plane of top 20 terminating in end 24. The opening distances referred to in the description of FIG. 2 may be more clearly seen in this picture.

The easiest way to install support 10 is to hang horizontal element 23 on toe 17, insert the ceiling sheet, slip the free end 18 on top of the toe of the next adjacent purlin and push up and in on support 10 to spring it into place over the purlin, release the pressure allowing the support to snap into place. For ease of installation it is important that the distance between end 24 and the top of angled end 19 be greater than the outside dimensions of the toe of the purlin. This allows the toe to be inserted into the hook without having to spring the horizontal element 23. Although it is not critical, since springing mechanism is provided by the balance of the construction, it is preferred that the distance between inside corner 26 and the horizontal place extension of top 20 be equal to or less than the outside dimensions of the toe of the purlin. If this distance is equal to the outside dimensions of the toe, no loss in the springing characteristics incurs. If it is less than the outside dimensions of the toe, an additional springing action takes place to further lock support 10 over the toe of the purlin. The springing action to hold the support in place is obtained by a combination of the flange angles, the height of the flanges, the dimension between corner 26 and the horizontal place of top 20 and the angle of downward end 19 from the plane of top 20. It is preferred that the upright element being angled to the plane of top 20 at an angle equal to or greater than the angle of the upraised toe from the lower horizontal of the purlin that it further be in the range of 35 to 60 degrees from the plane of top 20. In this fashion, horizontal element 23 engages only the top edge of toe 17. As pictured in FIG. 2 the angle of element 22 is essentially identical to that of toe 17. In preferred practice, it will be formed at a steeper angle than the toe of the purlin to provide a void between the pieces. Horizontal element 23 is almost parallel with the plane of top 20 and is preferably angled downwardly at an angle less than 10 degrees, preferably in the range of 1 to 5 degrees from the parallel relationship. This allows horizontal element 23 to engage the end of toe 17 and yet providing ease of installation.

While this invention has been described with reference to the specific embodiments disclosed herein, it is not confined to the details set forth and the patent is intended to include modifications and changes which may come within and extend from the following claims.

I claim:

1. In building structures constructed with purlins having a lower horizontal element with a raised toe, a support member to hold interior ceiling sheets across the roof between the purlins comprising:

(a) a metal member having a width and a length at least equal to the distance center to center of adjacent purlins plus sufficient additional length to allow bearing of one end of the member on the top of the toe of the lower horizontal of a purlin, (b) wherein the member is formed in an inverted U-shaped cross-section extending essentially the entire length of the member with inside angles of the U-shape being concave extending all the way to the end of the support member which rests on the lower horizontal of the purlin, (c) wherein the other end of the support member is formed across its width as a hook to slip over the upraised toe of the purlin comprising:

(i) an upright element coextensive with the width of a flattened portion of the other end of the U-shaped member structurally attached and extending at an angle from the horizontal plane of the top of the inverted U-shaped member equal to or greater than the angle of the upraised toe from the lower horizontal of the purlin, (ii) a horizontal element coextensive with the width of the flattened portion of the U-shaped member structurally attached and extending from the top of the upright element back toward and almost parallel to the top of the metal member, the horizontal element being angled slightly downwardly toward the top to form the hook shape, and (d) wherein the vertical opening between the top of the inverted U-shaped member and the exposed end of the horizontal element is greater than the vertical distance between the top of the upraised toe and the bottom of the lower horizontal of the purlin.

2. The support member of claim 1 wherein the flattened portion of the other end of the inverted U-shaped member is angled downwardly from the horizontal line of the top of the U-shaped member to the point where the upright element turns upwardly to form a spring member.

3. The support member of claim 1 wherein the angle of the upright element is in the range of five to 30 degrees.

4. The support member of claim 1 wherein the vertical distance between the inside corner between the upright element and the horizontal element and the line of a horizontal extension of the top of the inverted U-shaped member is less than the outside vertical dimension between the top of the upraised toe and the bottom of the lower horizontal of the purlin.

5. The support member of claim 1 wherein the concave angle of the inside angle of the U-shaped cross-section is greater than 90 degrees but less than 110 degrees.

6. The support member of claim 4 wherein the concave angle is about 100 degrees.

7. The support member of claim 1 wherein the angle of the upright element is about 35 to 60 degrees above the horizontal line extension from the top of the metal member.

8. The support member of claim 7 wherein the horizontal element is angled downwardly from the parallel configuration to an angle less than 10 degrees.

9. The support member of claim 7 wherein the horizontal element is angled downwardly from the parallel configuration to an angle in the range of one to five degrees.

10. In a building structure, constructed with purlins having a lower horizontal extension with the raised toe at the exposed end of the lower horizontal member, a support member to hold interior ceiling sheets across the roof between adjacent purlins comprising (a) a metal member having a width and a length at least equal to the distance center to center of adjacent purlins plus sufficient additional length to allow one end of the member to bear on the raised toe of the purlin, (b) wherein the metal member is formed in an inverted U-shaped cross-section extending essentially the entire length of the member with inside angles of the U-shape being concave and extending all the way to the end of the metal member which rests on the top of the purlin, (c) wherein the other end of the metal member is flattened across its width to form a hook to slip over the upraised toe of the purlin from below comprising (i) the flattened portion of the metal member near the end on which the hook is formed is angled downwardly from a horizontal line of the top of the inverted U-shape to form a spring element, (ii) the flattened member is angled upwardly coextensively with the width to an angle with the horizontal extension of the plane of the top of the inverted U-shape, the angle being equal to or greater than the angle of the upraised toe from the lower horizontal member of the purlin, and (iii) a horizontal extension, coextensive with the full width structurally attached and extending from the top of the upright element back toward and almost parallel to the top of the metal member, the horizontal extension being angled slightly downward toward the top of the metal member to form the hook shape, (d) wherein the vertical opening between the downwardly angled spring element and the exposed end of the horizontal element is greater than the outside vertical dimensional distance between the top of the upraised toe and the bottom of the lower horizontal member of the purlin, and (e) wherein the vertical distance between the inside corner between the upright element and the horizontal element and the plane of a horizontal extension of the top of the inverted U-shaped member is less than the outside vertical dimension between the top of the upraised toe and the bottom of the lower horizontal member of the purlin.

* * * * *